US006023922A

United States Patent [19]

Lancaster

[11] Patent Number: 6,023,922

[45] Date of Patent: Feb. 15, 2000

[54] GLAZED STRUCTURES

[75] Inventor: John Edward Lancaster, Clitheroe, United Kingdom

[73] Assignee: Ultraframe PLC of Enterprise Works, United Kingdom

[21] Appl. No.: 08/901,402

[22] Filed: Jul. 28, 1997

[51] Int. Cl.[7] ..... E04B 7/18

[52] U.S. Cl. ..... 56/200; 52/699

[58] Field of Search ..... 52/200, 699, 570

[56] References Cited

U.S. PATENT DOCUMENTS

| | | | |
|---|---|---|---|
| 4,635,419 | 1/1987 | Forrest . | |
| 4,788,804 | 12/1988 | Haas | 52/200 |
| 4,926,594 | 5/1990 | Sampson et al. | 52/200 |
| 4,928,445 | 5/1990 | Sampson et al. | 52/72 |
| 4,987,705 | 1/1991 | Sampson et al. | 52/72 |
| 4,995,208 | 2/1991 | Sampson et al. | 52/200 |
| 5,016,417 | 5/1991 | Mentken . | |
| 5,044,133 | 9/1991 | Sampson et al. | 52/72 |
| 5,103,603 | 4/1992 | Verby | 52/72 |
| 5,216,855 | 6/1993 | Richter et al. | 52/200 |
| 5,544,455 | 8/1996 | DeBlock | 52/200 |

FOREIGN PATENT DOCUMENTS

| | | |
|---|---|---|
| 0 398 586 A1 | 11/1990 | European Pat. Off. . |
| 1244304 | 8/1971 | United Kingdom . |
| 2 228 754 | 9/1990 | United Kingdom . |
| WO 94/18405 | 8/1994 | WIPO . |

OTHER PUBLICATIONS

U.K. Search Report Cover Sheet, The Patent Office, Date of Search May 8, 1996.

*Primary Examiner*—Beth Aubrey
*Attorney, Agent, or Firm*—Howell & Haferkamp, L.C.

[57] ABSTRACT

A lean-to conservatory construction has a sloping roof (10) mounted on a side wall, with a plastics furring piece (29) therebetween. The furring piece is formed by diagonal cutting of a rectangular section extrusion having an outer wall (30) and intersecting intermediate walls (33 and 34) forming ducts.

11 Claims, 2 Drawing Sheets

GLAZED STRUCTURES

BACKGROUND OF THE INVENTION

This invention concerns glazed structures, such as conservatories.

There are problems associated with constructing conservatories of the lean-to type, ie which have a sloping roof extending from an existing wall. The sloping roof may be supported at each end on side walls of the conservatory or on one side wall of the conservatory and an existing wall. In order to fill in the space between the sloping roof and the conservatory side wall special wooden furring (or "firring") pieces have to be cut and fitted. When the conservatory is constructed from U-PVC the wooden furring pieces have to be covered with special U-PVC cover trims so as not to spoil the appearance. The manufacture of the furring pieces and trims is time consuming and hence increases the cost of lean-to conservatory installation.

BRIEF SUMMARY OF THE INVENTION

An object of this invention is to provide a simpler lean-to conservatory construction.

According to the invention it is proposed that furring pieces for lean-to conservatory construction be made from plastics material.

Preferred furring pieces for use in the invention are made from plastics extrusions. The preferred extrusion has a rectangular section outer wall and intersecting intermediate walls forming ducts through the extrusion. The provision of intersecting intermediate walls provides structural strength whilst reducing weight compared to a solid extrusion.

As most furring pieces will be required to fill under a sloping roof a single extrusion may be cut diagonally from one end to the other to provide two furring pieces of the same size and shape, so that they can be used at opposite ends of the roof.

When a conservatory is being erected, there is often a need to compensate for differences in side wall positioning relative to the roof position at junctions thereof. The invention further provides a system for such compensation that may include the afore-mentioned furring pieces of the invention.

The glazing panel at the end of a conservatory roof is generally connected to a beam on which a capping member is fixed, the capping member preferably having gasket means provided or integral therewith to seal between an edge of the capping and a top surface of the glazing panel. The capping preferably has a depending formation that is a push fit into a channel of the beam.

Preferably a cap is provided intermediate the glazing beam and the furring piece whose position is laterally adjustable relative to the glazing beam and the cap preferably has a location for fixing a fascia board thereto, so that the cap, fascia board and the furring piece may be repositioned laterally as necessary to compensate for the relative positions of the glazing beam and the underlying conservatory side wall.

The glazing beam preferably further provides an upper location for the fascia board preferably by means of a sliding interfitment. The beam preferably has a lateral flange and the fascia board a slot into which the flange fits. Preferably at least one face of the slit is resiliently deformable tending to close the slot to provide grip on the flange.

BRIEF DESCRIPTION OF THE SEVERAL VIEWS OF THE DRAWINGS

The invention will now be further described, by way of example only, with reference to the accompanying drawings, in which.

DETAILED DESCRIPTION OF THE INVENTION

Figure 1:
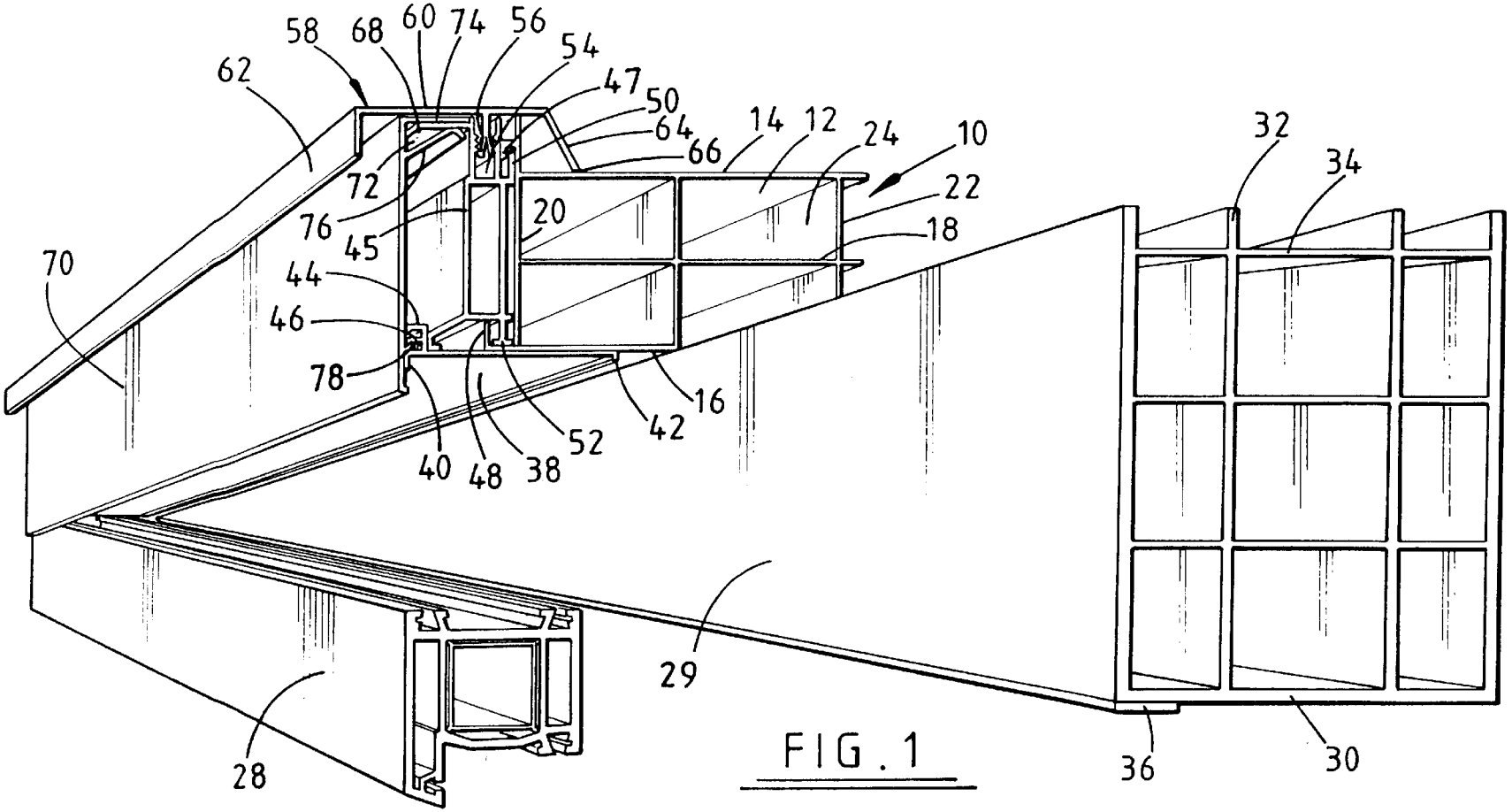
FIG. 1 is a perspective view of part of a lean-to conservatory.
Figure 2:
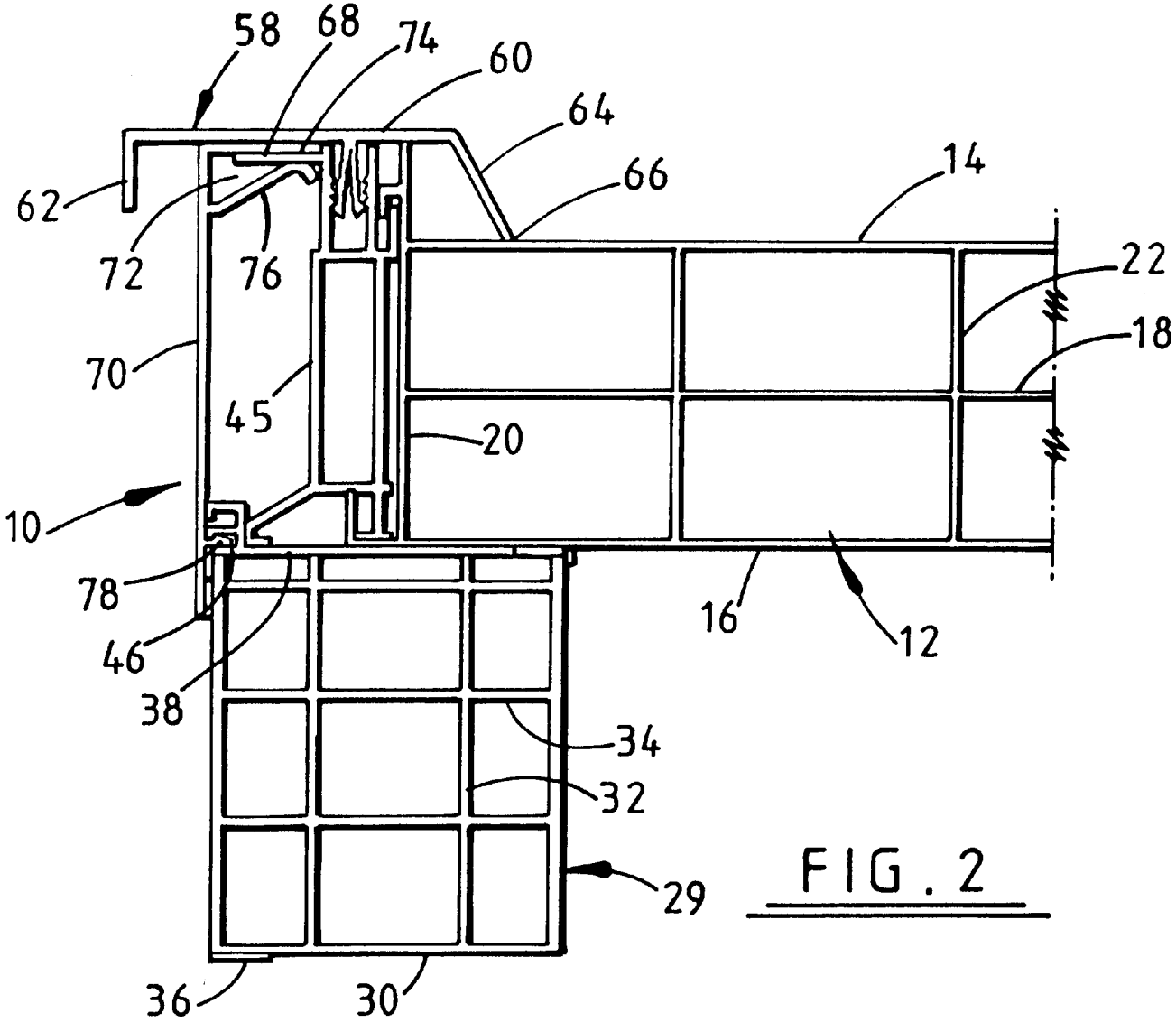
FIG. 2 is an end view of the same conservatory.

Referring to the accompanying drawings, a lean-to conservatory generally comprises two side walls with sloping top edges, a front wall and a sloping roof 10. The roof 10 comprises translucent plastics panels 12, which in the present case have top, bottom and intermediate walls 14, 16 and 18 respectively, end walls 20 and intermediate walls 22 parallel to the end walls in order to form ducts 24. The form of the roofing panels is not, however, essential to the present invention.

The side walls include a beam 28 which is generally horizontal. The sloping roof is mounted on that beam with a furring piece 29 therebetween to bridge the gap. The furring piece 29 is made from a plastics extrusion that is cut diagonally along its length to produce two furring pieces of the same size and overall shape that can be used at opposite ends of a lean-to conservatory. The extrusion has a rectangular section outer wall 30 and intersecting intermediate vertical and horizontal walls 32 and 34 respectively, so that, in effect, the extrusion is ducted. The intermediate walls 32 and 34 provide strength whilst reducing the weight of the furring pieces. On its underside the furring piece 29 has a strip of double sided sealing tape 36 to bond same to the. On top of the furring piece 29 is a cap 38 which has depending edges 40 and 42 so that it sits snugly onto the furring piece. The intended outer edge of the cap 38 has a formation 44 along its edge providing an outwardly open lipped slot 46.

The glazing panel 12 is connected to a glazing beam 45. The panel 12 has upper and lower formations 47, 48 respectively that interfit with formations 50, 52 respectively of the glazing beam 45. The panel and beam assembly sit on the cap 38 on the furring piece 29.

The glazing beam 45 has an upwardly open channel 54 into which fits a depending formation 56 of a capping piece 58 as a push-fit. The capping piece 58 has flat central section 60 with a depending flange 62 from its intended outer edge, a sloping section 64 from the central section to meet the top surface of the panel 12 and gasket material 66, preferably formed integrally with the edge of the sloping section 64 of the capping piece 58, in order to seal between the capping piece and the panel 12.

Extending laterally outwards from the glazing beam 45 is a flange 68. This flange together with the lipped slot 46 of the furring cap 38 provide locations for attachment of a fascia panel 70. The fascia panel 70 has a slot formation 72 at its upper end with convergent side walls 74 and 76 at least of which side wall 76 is resiliently deformable and tends to close the slot. The flange 68 is a sliding fit into the slot 72 near its lower end the fascia panel has lipped projection 78 which fits into the slot 46 of the furring cap 38. Thus, the fascia panel can be push fitted to the assembly prior to the fitting of the capping piece 58. The capping piece 58 is made sufficiently wide that the furring 29, the furring cap 38, and the fascia panel 70 can be repositioned as a whole laterally relative to the glazing beam 45 and the glazing panel 12. This allows for adjustments to be made when the conservatory is being erected to compensate for variations in the relative positioning of the conservatory side walls and the roof ends.

I claim:

1. A conservatory construction having a sloping roof supported on a side wall with a furring piece between the roof and the side wall, the furring piece being formed of a plastics extrusion, the furring piece having a first end, a second end remote from the first end, an outer wall forming a generally rectangular cross section of the furring piece and intersecting intermediate walls inside the furring piece forming ducts through the extrusion from the first end to the second end, the plastics extrusion having a cut from a bottom of the furring piece at the first end to a top of the furring piece at the second end.

2. A conservatory construction as claimed in claim 1, wherein the roof comprises at least one glazing panel having an end overlying the side wall and connected to a glazing beam on which a capping member is fixed.

3. A conservatory construction as claimed in claim 2, wherein the capping member has a depending formation that is a push-fit into a channel of the beam.

4. A conservatory construction as claimed in claim 2, wherein the capping member has gasket means to seal between an edge of the capping member and a top surface of the glazing panel.

5. A conservatory construction as claimed in claim 4, wherein the gasket means is integrally formed with the capping member.

6. A conservatory construction as claimed in claim 2, wherein a cap is provided intermediate the glazing beam and the furring piece and the position of the furring piece is laterally adjustable relative to the glazing beam.

7. A conservatory construction as claimed in claim 6, wherein the glazing beam has a flange along one edge to which a fascia board is fixed.

8. A conservatory construction as claimed in claim 2, wherein the glazing beam provides an upper location for a fascia board.

9. A conservatory construction as claimed in claim 8, wherein the upper location involves sliding interfitment.

10. A conservatory construction as claimed in claim 9, wherein the glazing beam has a lateral flange and the fascia board has a slot into which the flange fits.

11. A conservatory construction as claimed in claim 10, wherein the slot is provided by opposed faces and one of said faces is resiliently deformable.

* * * * *